US005320118A

United States Patent [19]

Fernholz

[11] Patent Number: 5,320,118

[45] Date of Patent: Jun. 14, 1994

[54] APPARATUS FOR DISPENSING SOLID RINSE AIDS

[75] Inventor: Peter J. Fernholz, Burnsville, Minn.

[73] Assignee: Ecolab Inc., St. Paul, Minn.

[21] Appl. No.: 19,785

[22] Filed: Feb. 19, 1993

[51] Int. Cl.[5] ..... A47L 15/44

[52] U.S. Cl. ..... 134/93; 134/107

[58] Field of Search ..... 134/93, 107, 176, 179, 134/200; 68/17 R

[56] References Cited

U.S. PATENT DOCUMENTS

| | | | |
|---|---|---|---|
| Re. 30,537 | 3/1981 | Fraula et al. | 134/10 |
| 2,038,260 | 4/1936 | Ash | 134/93 |
| 2,296,055 | 9/1942 | Ray | 134/93 X |
| 3,203,436 | 8/1965 | Wallgren et al. | 134/58 D |
| 3,827,600 | 8/1974 | Janke | 222/70 |
| 3,975,931 | 8/1976 | Bischkopf | 68/17 |
| 4,147,559 | 4/1979 | Fraula et al. | 134/57 |
| 4,235,642 | 11/1980 | Federighi et al. | 134/58 |
| 4,277,290 | 7/1981 | Andrews et al. | 134/10 |
| 4,420,005 | 12/1983 | Armstrong | 134/179 X |
| 4,624,713 | 11/1986 | Morganson et al. | 134/25.2 |
| 4,826,661 | 5/1989 | Copeland et al. | 422/106 |
| 4,836,229 | 6/1989 | Lakhan et al. | 134/93 |
| 4,872,466 | 10/1989 | Noren | 134/107 X |
| 4,938,240 | 7/1990 | Lakhan et al. | 134/93 |
| 5,100,032 | 3/1992 | Burdorf et al. | 222/377 |

FOREIGN PATENT DOCUMENTS

| | | |
|---|---|---|
| 0154421 | 9/1985 | European Pat. Off. . |
| 0180282 | 5/1986 | European Pat. Off. . |
| 0461870 | 12/1991 | European Pat. Off. . |
| 0495183 | 7/1992 | European Pat. Off. . |
| 1628464 | 1/1971 | Fed. Rep. of Germany . |

OTHER PUBLICATIONS

"Drymaster Model P/2000 Installation and Operation Manual", Ecolab Institutional Division (1990).

"Rinse Miser Model S-3000 Installation and Operation Manual", Ecolab Institutional Division (1990).

*Primary Examiner*—Philip R. Coe

*Attorney, Agent, or Firm*—Merchant, Gould, Smith, Edell, Welter & Schmidt

[57] ABSTRACT

An apparatus and method for dispensing solid rinse aids is disclosed. The dissolved solid rinse aid is dispensed from a dispenser (100) to a solution tank or reservoir (40) which uses the heat of a high temperature warewash machine (10) to prevent bacterial or microbial growth and degradation of rinse aid solutions held within the reservoir (40). The dispenser (100) is a solid rinse aid dissolving unit that is preferably a gravity feed device dispensing solutions to the solution tank (40) located within the warewash machine (10). The dispenser (100) is fed with hot tap water or final rinse water to dissolve the solid rinse aid.

11 Claims, 4 Drawing Sheets

APPARATUS FOR DISPENSING SOLID RINSE AIDS

FIELD OF THE INVENTION

The invention relates generally to the dispensing of solid water soluble compositions used in cleaning processes. More specifically, the invention relates to the storage and dispensing of a rinse aid solution from a solid block of rinse aid. Typically, the rinse aid solution is created by contacting the solid block composition with a dissolving liquid such as water.

BACKGROUND OF THE INVENTION

Both institutional and consumer automatic dishwashers or warewashing machines have been in use for many years. These dishwashers typically function with two or more cycles, including various combinations of a soak or prewash, a main wash, a rinse, and a high temperature sanitizing rinse cycle. A dishwasher detergent composition is typically utilized during the wash cycle to remove soil and stains. Often, the detergent composition will include water softeners or sequestrants, bleaching and sanitizing agents, and an alkali source. Dishes and other wares washed in automatic washing machines are preferably obtained without food soils and without residue from the cleaning solutions or other chemicals used in the washing process.

One type of residue, known as streaking and spotting, is common on machine washed dishes. Streaking and spotting is believed to result when water salts deposit on the dishes after the rinse cycle drainage and evaporation. Rinse additives or aids are commonly added to rinse water in an effort to reduce surface tension of the rinse water and thereby promote sheeting of the water from the dishes. Typical rinse aid formulas require solution concentrations ranging from about 250 ppm to 1,000 ppm (depending on actives) to provide efficient sheeting and drying.

For many reasons, separate rinse additives or aids are an important part of the automatic dishwasher operation. In general, rinse aids minimize spotting and promote faster drying by causing the rinse water to sheet off of the clean dishes and other wares evenly and quickly. Rinse aids are generally used in a cycle separate from cycles using the detergent composition, although some detergent residue may be present in the rinse water. Rinse aids are currently available in liquid or solid form.

Solid rinse aids are generally more convenient, safe and economical than liquid rinse aids because they do not spill or splash, have reduced manufacturing and distribution costs, and require less storage space. Solid rinse aids are available for consumer and institutional warewashing machines. For use in a typical consumer wash machine, each solid rinse aid generally incorporates a disposable container or basket which is hung directly inside the machine. Circulation of water within the wash machine in the normal course of the machine cycles slowly dissolves the solid rinse aid, thus dispensing it. The water temperature in consumer wash machines typically is about 60° to 180° F.

Institutional warewashing machines are generally either low temperature chemical sanitizing machines with a water temperature ranging from about 120° to 140° F., or high temperature machines with a water temperature of about 160° to 180° F. A low temperature warewashing system can be more desirable than a high temperature system because it avoids the heating expenses associated with the hotter water. In addition, it is much simpler to dispense a rinse aid in a low temperature system. A quantity of rinse water can be added to the sump of the automatic dishwashing machine in a low temperature system and circulated to rinse the dishes before draining. In such a system, the rinse aid need only be provided to the sump, and will function as the water circulates.

By contrast, in a high temperature warewash system, dissolved rinse aid is injected into the pressurized rinse water line prior to entering the machine and is then sprayed over the dishes through a rotating spray arm. A continuous stream of hot water is commonly provided through the spray arm for rinsing. Consequently, a rinse aid for use in a high temperature system must be dispensed into and sufficiently dissolved in the hot water stream against a back pressure before the water leaves the spray arm and contacts the dishes or other wares. This generally requires a more complex dispensing system.

One of the difficulties encountered in the use of a rinse aid is that the rinse cycle is typically the last cycle in the warewashing process, permitting solubilized particles of the rinse aid to remain on the clean dishes. Because of the possibility for ingestion of surface residual rinse aid, some countries require that such residue be of food grade quality.

Researchers have struggled with the problem of effectively applying and preserving solutions of solid rinse aid additives regardless of formulation type. Microbial activity is feared as a potential health risk, can result in biomass plugging of the dispensers, and can aesthetically deteriorate solid rinse aid products. A less than effective method has been to formulate into solid rinse aids relatively toxic preservative materials (e.g., formaldehyde, glutaraldehyde) to preserve the dispenser generated solutions from mold and bacterial growth. However, in some countries such as Japan, no toxic materials or preservatives are permitted for use in rinse additive compositions which can remain on food service wares once the washing process is complete.

Accordingly, a substantial need exists for an apparatus and method for preserving solid food grade rinse aids during the dispensing process without use of toxic preservative materials.

SUMMARY OF THE INVENTION

A dispensing system for a solid wash chemical such as a solid rinse aid is provided. The dispensing system includes a warewash machine having a plurality of walls defining at least one chamber for washing and rinsing soiled wares. A dispenser is positioned outside of the warewash machine and comprises a housing for containing a Solid block of rinse aid, and a spray means for directing a dissolving spray of an aqueous liquid at an exposed surface of the solid block of rinse aid. A concentrated rinse aid solution at a substantially constant concentration is thereby provided to an outlet in the dispenser. A reservoir or tank for the rinse aid solution has a feed line conduit cooperatively attached to the outlet of the dispenser, and the reservoir is attached to an inner surface of one wall of the warewash machine. The rinse aid solution is directed to the reservoir from the dispenser outlet through the feed line conduit and stored in the reservoir for a period of time effective to preserve the rinse aid solution from biological contamination. The rinse aid solution is preserved in the reservoir by an elevated temperature present in the warewash machine during its operation.

Preferably, the water supplied to the warewash machine is maintained at a temperature of between about 120° to 180° F. Preferably, the dispenser is a solid rinse aid dissolving unit which is essentially a gravity feed device dispensing solutions ranging from about 0.5 to 5 wt-% rinse aid to the solution tank or reservoir located in the warewash machine. The dispenser is fed with hot tap water or final rinse water in order to dissolve the solid rinse aid. The reservoir or tank is preferably mounted to an inner wall of the wash machine, and has upper and lower openings allowing mounting of an inlet feed line and an outlet pick-up line. The reservoir is preferably made from a heat resistant material which can withstand the corrosive detergent environment present in the warewash machine during its operation.

A method for dissolving and dispensing a solid block of rinse aid in the form of a concentrated solution comprises the steps of placing a solid block of rinse aid into the dispenser described above and spraying an aqueous liquid from the spray means onto an exposed surface of the solid block of rinse aid, thereby forming a concentrated rinse aid solution. The concentrated rinse aid solution is then directed to a reservoir disposed within a warewash machine where it is stored for a period of time effective to preserve the rinse aid solution from biological contamination. The concentrated rinse aid solution is then pumped from the reservoir to an injection point where it is combined with an aqueous liquid to form an end use solution which is directed to a utilization point in the warewash machine. The rinse aid solution is preserved from biological contamination by the elevated temperature present in the warewash machine during its operation.

As used herein, the term "utilization point" refers to the place where the solution is used, such as a wash tank, rinse tank, a rinse spray nozzle, a pressurized water line, etc.

As used herein, the term "wash chemical" refers to those chemical components or chemical mixtures commonly added to aqueous liquids present in machine washing sections to aid in the cleaning and rinsing of wares and other items. Such wash chemicals include detergents, builders, sequestrants, rinse aids, etc.

As used herein, including the claims, the terms "dishes" or "wares" are employed in the broadest sense to refer to the various types of articles used in the preparation, serving and consumption of foodstuffs. Such articles include pots, pans, trays, pitchers, bowls, plates, saucers, cups, glasses, forks, knives, spoons, spatulas, and the like.

One aspect of the present invention is a dispensing system apparatus for dispensing a solid rinse aid. Another aspect of the invention is a method of preserving and dispensing a solid rinse aid solution. Further advantages and features of the invention can be seen by reference to the accompanying drawings and description, in which there is illustrated and described a preferred embodiment of the invention.

BRIEF DESCRIPTION OF THE DRAWINGS

In the drawings, which form a part of the instant specification and are to be read therewith, a preferred embodiment of the invention is shown, and in the various views, like numerals are employed to indicate like parts.

DETAILED DESCRIPTION OF THE INVENTION

Figure 1:
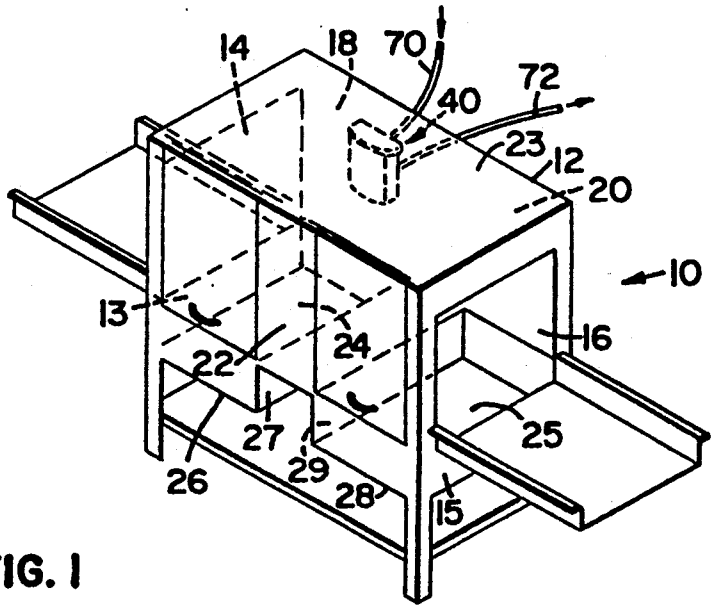
FIG. 1 is a perspective view of a conveyor dishwashing machine having attached thereto a rinse aid solution tank according to the present invention.

The invention is directed to a dispensing system which uses a rinse aid solution tank disposed within a warewashing machine and heated by the wash environment for preserving the solution from bacterial or mold contamination. Referring to the drawings, FIG. 1 illustrates a conventional conveyor dish machine 10 having a housing 12, which is provided for washing and rinsing of food ware items. Side walls 13 and 15 have openings 14 and 16 which provide access for loading and unloading of chamber 18 with a tray of wares such as dishes, glasses, utensils, or similar items which are to be washed. Chamber 18 is defined by sidewalls 20 and 22, top wall 23, and integral wash water sumps 24 and 25 which are defined by lower side walls 27, 29 and bottom walls 26, 28.

Figure 3:
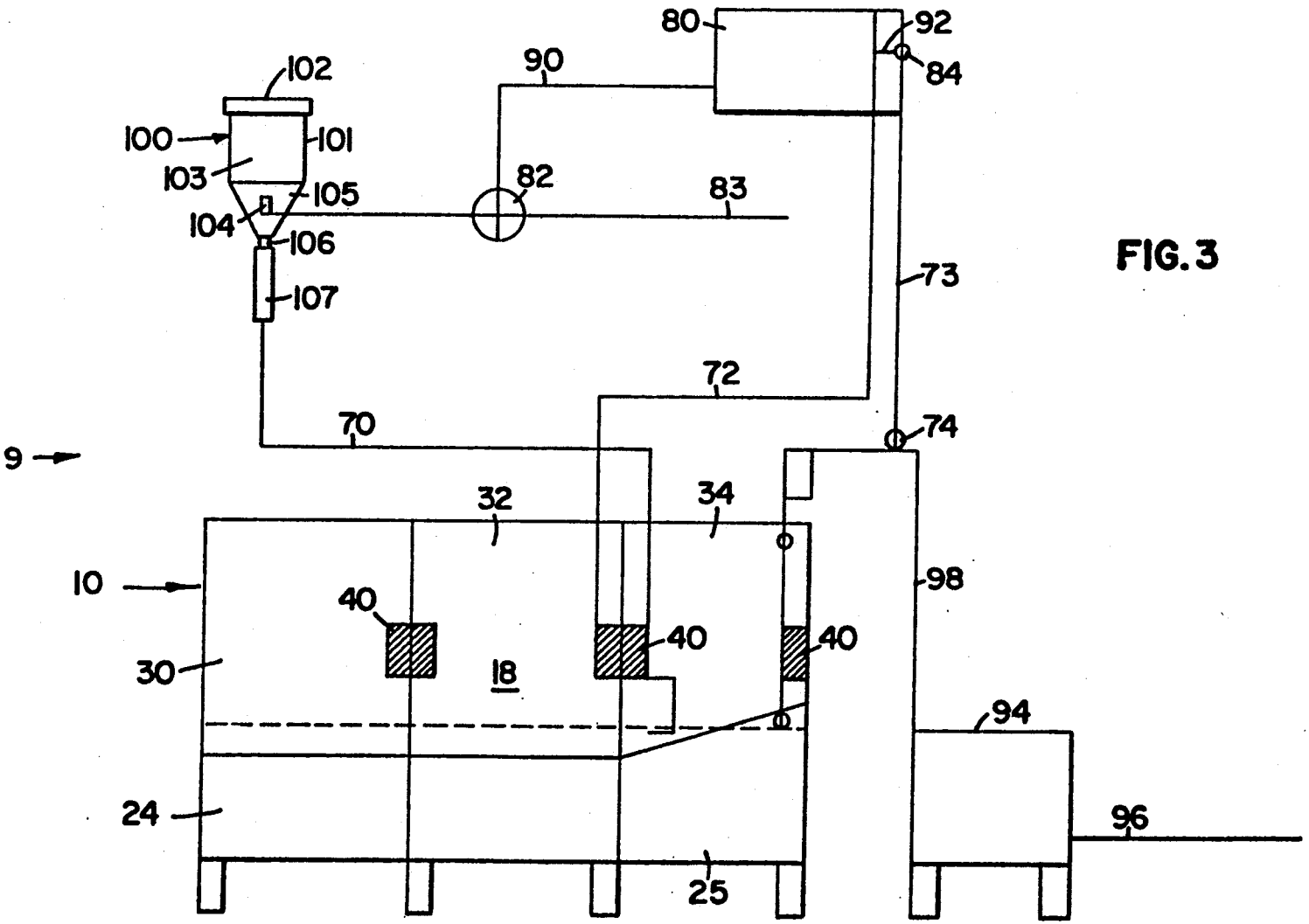
FIG. 3 is a schematic block diagram of a conveyor dishwashing system embodying the invention.

As shown in FIG. 3, chamber 18 has wash section 30, power rinse section 32, and final rinse section 34. Wash spray arms (not shown) are mounted within chamber 18 to be rotatably driven by the force of high velocity jets of wash water exited from nozzles. Larger warewash machine versions have stationary wash arms. The wash spray arms are located preferably below and above an open mesh rack and tray in chamber 18. A predetermined concentration of detergent can be maintained in wash sump 24 automatically by commercially available means, the operation of which is well known and requires no further description to an understanding of the invention.

Figure 2:
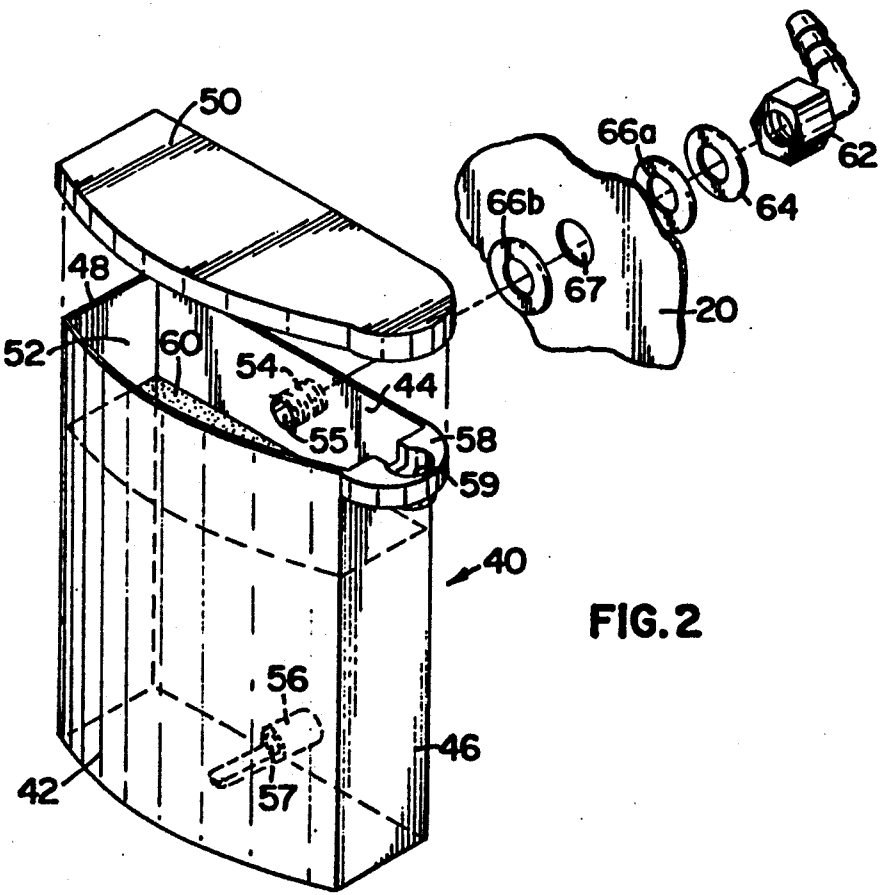
FIG. 2 is a close-up perspective view of the rinse aid solution tank depicted in FIG. 1.

Referring again to FIG. 1, a rinse aid solution tank or reservoir 40 is shown attached to the inner surface of sidewall 20 of warewash machine 10. The solution tank 40 is preferably constructed so that it does not interfere with the components of the conveyor dish machine during operation. Referring to FIG. 2, solution tank 40 is shown in greater detail. Solution tank 40 has front wall 42, back wall 44 and sidewalls 46 and 48. A cover 50 can be placed over opening 52 of solution tank 40. A rinse aid solution 60 is shown in solution tank 40 which has been fed from a solid rinse aid dispenser located outside of the wash machine environment. The dispenser will be discussed in greater detail below. A lip 58 having an overflow aperture 59 extends outwardly from opening 52 and side wall 46 to remove any excess volume of solution generated by the dispenser dissolving unit.

Materials used for construction of tank 40 can include plastics such as polymethylpentene, polypropylene, or other relatively hard durable heat resistant moldable plastic resins. Metallic materials may also be utilized in forming the solution tank such as stainless steel and other metallic materials which provide for heat transfer. It is preferable that the solution tank reservoir be made of materials which provide for heat transfer, as well as resistance to the detergent environment. Preferably, the tank 40 is made of a transparent or translucent material to allow the operator to see the amount of rinse aid in the tank 40. In the preferred embodiment, the tank 40 is made of a plastic material, such as polymethylpentene or polypropylene, and is formed of a single unitary piece. These types of plastic materials are transparent and have resistance to heat and chemicals. It is to be understood that the design or shape of the tank 40 for the rinse aid solution is not critical as long as it allows the solution to be preserved by the heat generated in the wash environment.

The solution tank 40 is intended to be initially filled by priming to roughly two-thirds volume (e.g., about 350 milliliters) followed by intermittent feed or draw down of solution and subsequent makeup of the draw down volume. This entire balance of tank content plus or minus 20% is to be controlled by the dispenser electronic control (discussed in greater detail below). Any excess generation of rinse aid solution due to changes in water flow rate and pumping rate overflows into the wash machine where it may enhance the cleaning performance of the machine.

Solution tank 40 is attached to side wall 20 of dish machine 10 by any suitable attaching means. Solution tank 40 is preferably mounted to side wall 20 with upper and lower mounting bulkhead fittings 54 and 56 having openings 55 and 57 therein, for connection to the inlet and outlet lines 70, 72. Preferably, a female hose fitting 62, washer 64 and rubber gaskets 66*a*, 66*b* are cooperatively connected to bulkhead fitting 54 which has been inserted through opening 67 in side wall 20, in attaching solution tank 40 to dish machine 10 as shown in FIG. 2. The above arrangement can also be used in attaching bulkhead fitting 56 to side wall 20.

In operation, a dissolved solid rinse aid solution concentrate is gravity fed to solution tank 40 through line 70 connected to bulkhead opening 55. The dissolved rinse aid solution 60 is drawn from the bottom of tank 40 through bulkhead opening 57 and directed to a utilization point where it is further diluted and sprayed onto wares during the final rinse phase of a washing process. Drawing solution 60 off the bottom of tank 40 assists in purging the tank of any sediment or solids from the solid rinse aid product.

Referring to FIG. 3, a dispensing system schematic is indicated generally at 9. A schematic view of conveyor dish machine 10 shows various optional locations where solution tank 40 can be located. As shown in FIG. 3, solution tank 40 can be placed in wash section 30, power rinse section 32, or final rinse section 34. The placement of solution tank 40 within dish machine 10 is not critical as long as tank 40 is exposed to the heat generated in chamber 18. A booster heater 94 is located adjacent to dish machine 10 for heating the water used in the dish machine operation. Hot water line 96 is connected to booster heater 94 where the water is heated up to temperatures of about 180° F. before entering water line 98 for conveyance to dish machine 10.

A solid rinse aid dispenser 100 is employed away from dish machine 10 for dissolving the solid rinse aid. Dispenser 100 has a housing 101 with an upper storage portion 103 defining a cavity for holding a solid rinse aid composition. A removable cover 102 extends across the upper end of the storage portion 103 so as to provide access to the cavity within the storage portion 103. A spray nozzle 104 is located within dispenser 100 and a water line 83 is operatively connected to spray nozzle 104 for directing a water spray at the solid rinse aid. At the lower end of the housing 101 is a collector portion 105. Preferably, the spray nozzle 104 directs water upwardly so as to impinge upon the solid block of rinse aid, at which time the resulting dissolved solution descends through the collector portion 105. The lower end of the collector portion 105 defines an outlet port 106 for passage therethrough of solution collected by collector portion 105. Conduit 107 extends from the outlet port 106 and is operatively connected to outlet feed line 70. The outlet port 106 directs the rinse solution downwardly by gravity. If the rinse solution is not fed by gravity, a solution pump (not shown) can be provided in the outlet conduit 107. Preferably, the dispenser unit gravity feeds rinse aid solution ranging from about 2 to 5% strength to the solution tank located in the wash machine.

Control of the dispensing of the rinse aid solution from the dispenser housing 101 is done by controlling the flow of water to spray nozzle 104. Preferably, electronic controller 80 provides automatic timed control of electrically operable solenoid valve 82 which is operatively connected to water line 83, and pump 84 which is operatively connected to pick-up line 72. In the preferred embodiment, the pump 84 is a peristaltic pump and hot tap water or final rinse water from the wash machine may be used in water line 83. Electrical control for valve 82 is connected to controller 80 through control line 90 which is preferably a 24 volt line connection. Electrical actuating control for pump 84 is connected through control line 92. Control of the dispensing of the rinse aid solution from the dispenser may also be done in other ways, including mechanical means such as hydraulic timer valves and electrical means such as electrical switching in the control system of the washing machine 10.

The dispenser electronic controller 80 preferably has appropriate logic circuit means to perform the following functions: (1) activate the motor of pump 84 upon receiving a signal from a final rinse pressure switch or solenoid valve 82; (2) control the pump motor speed; (3) time and/or count the motor RPM and activate the solenoid valve 82, thereby feeding water to the dispenser unit 100 on a preset proportional basis; (4) provide timer or other electronic setting feature for proportional water feed control to the dispenser 100; (5) provide a tank prime feature for filling the solution tank 40 at installation or during service calls; and (6) provide for a setting of motor speed (RPM) to control the volume of rinse aid solution injected.

In operation, the electronic controller 80 activates the motor of pump 84 upon receiving a signal from solenoid valve 82. The solenoid valve 82 is activated at a predetermined time, feeding water to the solid rinse aid dispenser on a preset proportional basis through spray nozzle 104 thereby dissolving a predetermined amount of solid rinse aid. The dissolved rinse aid solution is then gravity fed through outlet feed line 70 to solution tank 40 within dish machine 10. Upon an appropriate signal from controller 80, the rinse aid solution is drawn from solution tank 40 through pick-up line 72 by rinse pump 84. The rinse aid solution is then pumped through injection line 73 to the injection point 74 where the solution is injected into hot water line 98. The diluted rinse aid solution is then directed to the final rinse section 34 of dish machine 10 where the rinse aid solution is sprayed on wares during the final rinse phase of the washing operation.

Optionally, a float (not shown) can be positioned within the tank 40 and operatively connected to a float switch (not shown). The float switch is operatively connected to spray control means such as solenoid valve 82 for controlling the flow of water to the nozzle 104, so as to maintain a constant level of rinse aid solution in tank 40. When the level of rinse aid solution in tank 40 is below the desired constant level, the float switch is electrically closed and the spray control means is opened so that additional rinse aid solution is formed until the float returns to its desired level.

Figure 4:
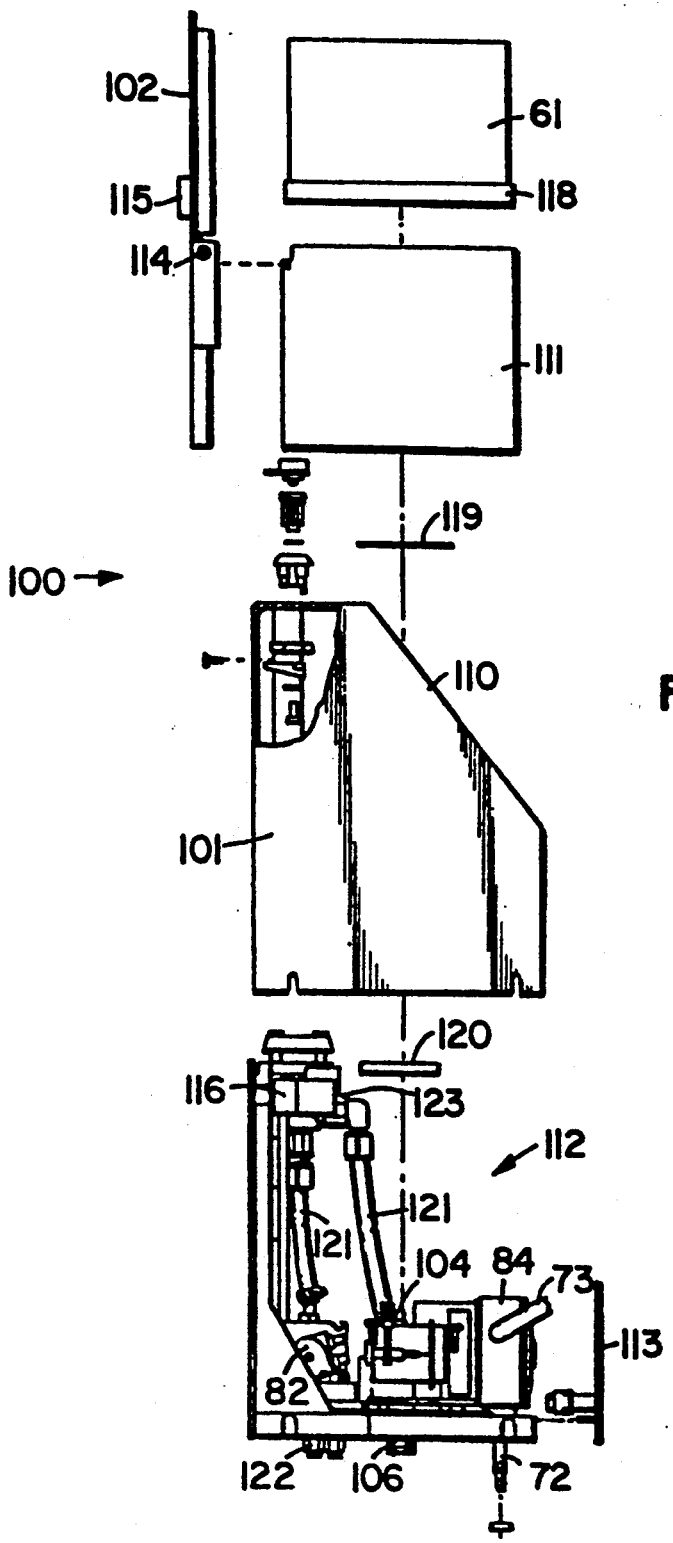
FIG. 4 is a side elevational exploded view of a dispenser for use in the present invention.

An exploded side view of a preferred dispenser assembly 100 is shown in FIG. 4. The dispenser 100 is preferably configured so that it can be mounted upon a wall near the wash machine 10. The housing 101 preferably has a hood 110, the upper portion of which holds the container 111 for the solid rinse aid product 61 and the lower portion of which contains electronic flow control assembly 112. The hood 110 is preferably made of a stainless steel or molded plastic material. The size and shape of the container 111 conforms with the size and shape of the solid product 61 and is preferably cylindrical. A front panel assembly 113 is attachable to the front portion of the hood 110. The container 111 is made of a clear or translucent plastic material, or contains a clear window, so as to indicate to the operator the level of solid rinse aid 61 contained therein.

The cover or door 102 is sealingly connected to the housing 101 by means of a hinge 114. In the preferred embodiment, there is a magnet 115 on the cover 102 which controls the opening and closing of a proximity switch 116. Opening of the cover 102 causes the proximity switch 116 to open and to turn off operation of the solenoid valve 82 which controls water flow. This provides a safety feature to prevent the operator's exposure to dissolved rinse aid solution.

Grates 118 and 119 are preferably positioned below the solid rinse aid 61, with the grate 118 having relatively large apertures and supporting the solid rinse aid 61. The grate 119 is positioned within the hood 110 and has relatively small apertures, on the order of one-half inch in diameter in the preferred embodiment, so as to trap undesirable particles from entering the rinse aid solution. There is a seal 120 which serves as a divider between the wetted rinse aid portion above the seal 120 and the electronic flow control assembly 112 below the seal 120. The seal 120 could be a U-cup, an 0-ring or any other suitable configuration.

Water enters the dispenser's water supply line 121 at water inlet point 122. The water line 121 is provided with a vacuum breaker assembly 123 which prevents backflow of the rinse aid solution into the water supply line. The solution then exits through outlet port 106 into conduit 107 connected to feed line 70. The rinse aid solution is then directed to tank 40 via feed line 70. Operatively connected to tank 40 is pick-up line 72. When rinse aid solution is needed in the wash machine 10, the pump 84 is energized and solution is withdrawn from the tank 140 via the pick-up line 72. The feed line 70 and pick-up line 72 are preferably made of a polypropylene material. In a preferred embodiment, each dispensing cycle produces approximately 70 milliliters of liquid rinse aid and the volume of tank 40 is enough for approximately five to ten cycles in the wash machine 10. By making up a quantity of rinse aid solution and storing it in tank 40, the solution is immediately available whenever the cleaning system 9 calls for it.

A variety of rinse aid compositions can be utilized in the present invention. Preferably, the rinse aid is employed in solid form and can include petrochemical based rinse aids formulated with low foam ethylene oxide/propylene oxide containing nonionic surfactants, or food grade rinse aids based on sugar esters, glycerol fatty acid esters, etc. A preferred solid rinse aid composition is a concentrated, low foaming, solid rinse aid composition formulated from food grade components which is effective in controlling spotting and streaking at relatively low solution concentrations and has a relatively low solubility rate which facilitates controlled dispensing. A particularly preferred solid rinse aid for use in the invention comprises a sorbitan aliphatic ester, a sucrose aliphatic ester, and a polyglycerol fatty acid ester. Optionally, a water soluble filler and a processing aid for facilitating homogenous processing of the composition may be employed.

Suitable sorbitan aliphatic esters are sorbitan fatty acid esters which may be derived by esterification of sorbitol with such fatty acids as lauric, myristic, palmitic, stearic, oleic, linoleic, and similar saturated and unsaturated, branched and straight chain fatty acids. Preferably, the fatty acids are $C_{6-24}$ straight chain fatty acids having less than three unsaturated carbon bonds. The preferred useful sorbitan fatty acid esters include monoesters, such as sorbitan monocaprylate, sorbitan monolaurate, sorbitan monopalmitate, sorbitan monostearate, sorbitan monooleate, sorbitan monolinoleate, sorbitan monoeleostearate, sorbitan monopentadecanoic acid ester, sorbitan monoheptadecanoate; diesters such as sorbitan sesquistearate and sorbitan sesquioleate; and triesters such as sorbitan tristearate and sorbitan trioleate.

Suitable sucrose aliphatic esters are sucrose fatty acid esters which are generally solid at room temperature and can also assist in solidifying the rinse aid composition. The sucrose fatty acid esters suitable for use in the rinse aid composition include mono- to octa-fatty acid esters and mixtures thereof. Sucrose fatty acid esters may be derived by esterification of sucrose with such saturated fatty acids as acetic, propionic, butyric, valeric, caproic, enanthic, caprylic, pelargonic, captic, lauric, myristic, palmitic, and stearic; unsaturated fatty acids such as palmitoleic, oleic, vaccenic, linoleic, sorbic, linolenic, and arachidonic; and similar saturated and unsaturated, branched and unbranched fatty acids. A preferred sucrose fatty acid ester for use in the rinse aid composition is a mixture of about 2 to about 12 wt-% sucrose laurate and about 25 to about 85 wt-% sucrose palmitate. Such a mixture provides effective sheeting action and rinsing performance while contributing to the formation of a solid product with beneficial dispensing characteristics.

Suitable polyglycerol aliphatic esters are the polyglycerol fatty acid esters. Suitable polyglycerol fatty acid esters include specifically, but not exclusively, those derived by esterification of a polyglycerol with such saturated fatty acids as acetic, propionic, butyric, valeric, caproic, enanthic, caprylic, pelargonic, capric, lauric, myristic, palmitic, and stearic; unsaturated fatty acids such as palmitoleic, oleic, vaccenic, linoleic, sorbic, linolenic and arachidonic; and similar saturated and unsaturated, branched and unbranched fatty acids. A preferred polyglycerol fatty acid ester for use in the rinse aid composition is decaglycerol monolaurate.

One or more solid, water soluble food grade fillers may be employed in the rinse aid composition for adjusting the hardness and/or solubility of the composition without significantly interfering with the desired functioning of the other components. Typical fillers useful in the composition include sugars such as glucose, fructose and sucrose; alkali metal salts such as sodium chloride, potassium chloride, sodium bicarbonate, sodium sulfate, potassium sulfate, sodium acetate, sodium lactate; water soluble amino acids such as alanine, arginine, glycine, lysine and proline; and phosphates such as tetrasodium pyrophosphate. Suitable processing aids capable of modifying the viscosity of the composition mixture during processing without substantially interfering with solidification of the composition or the functioning of the other components include specifically, but not exclusively, propylene glycol, glycerine, sorbitol, sugar and the like.

A preferred solid rinse aid for use in the invention comprises about 2 to 20 wt-% of a sorbitan fatty acid ester, about 35 to 80 wt-% of a sucrose fatty acid ester, and about 2 to 20 wt-% of a polyglycerol fatty acid ester. Optionally, about 5 to 40 wt-% of a water soluble filler can be employed. The solid rinse aid may also optionally include up to about 10 wt-% of a processing aid for facilitating homogenous processing of the composition.

The above rinse aid composition is effective for significantly reducing spotting and streaking at solution concentrations of about 20 to 250 ppm, with optimum performance occurring at concentrations of about 50 to 150 ppm. Such reduced solution concentration simplifies dispensing of the rinse aid and decreases foaming. The solid rinse aid diluted in rinse water is effective for preventing the spotting and streaking of dishes commonly associated with automatic machine washing. The rinse aid reduces the surface tension of the rinse water to promote sheeting action and to prevent spotting or streaking caused by beaded water after rinsing is complete. Since all components are food grade, the rinse aid composition alleviates any health concerns associated with residual deposits of the composition upon cleaned dishes.

The solid rinse aid employed must possess sufficient structural integrity under prolonged conditions of high heat (about 140° to 180° F.) and high humidity (dew points of about 100° to 180° F.) to permit controlled dispensing of the rinse aid from the dispenser. Preferably, the solid rinse aid is in the form of a contiguous cast solid, weighing greater than about 5 grams, preferably greater than about 200 grams, and has a regular geometric form. Such forms include a sphere, a cylinder, a truncated cone, a cube or rectangular block, etc. The solid rinse aid product is dimensioned and packaged in order that an effective concentration of the rinse aid can be obtained by an aqueous spray upon the surface of the cast solid material.

The present invention provides a method for generating solutions from a solid rinse aid and heat preserving these solutions in a reservoir or tank located within the wash machine by using the heat generated inside the wash machine. While prior solid and liquid rinse aids require use of a toxic preservative to prevent microbial growth, the present invention utilizes the heat of the wash machine to preserve the rinse aid solution. The placement of the rinse aid solution tank or reservoir inside of the warewash machine prevents microbiological and mold growth in the rinse additive solution. The present invention will deliver high performance, preserved rinse aids to all types of dish machines, including both consumer and institutional single tank and multi-tank conveyor machines.

A method of preserving a rinse aid solution in a warewash system comprises the steps of directing a dissolved rinse aid solution from a solid rinse aid dispenser to a reservoir or tank disposed within a warewash machine, and allowing the solution to remain in the tank for an effective period of time to preserve the solution from biological contamination. The solution is preserved by an elevated temperature within the warewash machine during operation thereof.

The present invention uses the hot wash machine environment to preserve solutions of a solid rinse aid which once dissolved and held for dispensing have a tendency to biodegrade, such as solid food grade rinse aids. The ambient heat generated within the wash machine provides a number of benefits. First, it maintains the rinse aid within the solution tank at a temperature which prevents the formation of mold or bacterial growth. Second, the rinse aid is maintained at a temperature which prevents the formation of precipitates or other solid masses which may prevent its dispensing to the wash machine.

In a preferred embodiment, the present invention operates by using the heat of a high temperature conveyer dishwash machine in either the final rinse, power rinse or wash sections, to prevent biological contamination such as mold and microbial growth and resulting degradation of rinse aid solutions stored in a solution tank disposed in the machine. As any dishwash machine goes through periods of down time, microbial growth can be initiated upon cooling. However, once the dishwash machine is restarted, a major log reduction (kill) in contaminating microorganisms occurs, thus maintaining a safe, effective, unfouled, and aesthetically pleasing rinse aid solution.

A method for operating the dispensing system of the invention utilizing a solid rinse aid composition comprises the steps of providing a warewash machine having adjacent wash and rinse chambers and a wash water sump which, after an initial filling with wash water, is maintained at a desired wash water level at a desired wash water temperature by drainage of water into such wash water sump after wash and rinse spraying of food ware items. A load of food ware items is inserted into the warewash machine wash chamber and is washed by pumping wash water from the wash sump to provide pressurized discharge of such wash water for wash spraying of such food ware items. Heated water is directed within a rinse line under pressure to provide pressurized discharge for rinse spraying on the washed load. A liquid chemical rinse aid is directed into the flow of heated water in the rinse line, with the introduction of rinse aid into the rinse line taking place shortly prior to rinse spraying of the washed load. The introduction of the rinse aid is controlled to take place over at least a predetermined major portion of a preselected rinse phase time. The rinse aid solution is preserved from biological contamination within the wash machine prior to injection into the rinse water.

While the present invention has been shown and described in combination with a conveyor dishwash machine, it is to be understood that any dishwash machine can utilize the method and apparatus of the invention to prevent microbial growth and other biological contamination in a rinse aid solution. Furthermore, liquid rinse aids may also be utilized in the present invention although solid rinse aid compositions are preferred.

The invention will be further understood by reference to the following Examples.

EXPERIMENTAL EXAMPLES

Examples 1–14

Each of the rinse aid compositions of Examples 1–14 listed in Table I below were prepared by mixing the listed components in a beaker with the powdered/granular components blended prior to addition of the liquid components. The component L-1695 TM, when employed, was powdered with a mortar and pestle prior to blending in the beaker. A thermometer was placed in the beaker and the mixture heated in a microwave oven to a temperature of between about 190° F. to about 250° F. (unrecorded) with occasional removal and stirring of the heating mixture with a spatula. The heated rinse aid mixture was then scraped from the beaker into one or more plastic cups, allowed to cool and solidify at room temperature, and removed from the cup.

Example 15

Solutions of a food grade solid rinse aid were prepared at concentrations of 0.5%, 1.0% and 2.0% in city water. The ingredients and amounts in the solid rinse aid are listed below in Table II.

TABLE II

| Ingredient | Solid Rinse Aid Amount (wt-%) |
|---|---|
| Sucrose ester (P1570S) | 76 |
| Decaglyn (1-L) | 10 |
| Sorbitan ester (SK-10) | 14 |
| | 100 wt-% |

Six 500 ml sterile polypropylene bottles were filled, two from each solution of the above rinse aid. One bottle of each solution was inoculated with a mixed bacteria culture. The other was inoculated with a mold suspension Aspergillus niger. The bottles were placed upon the scrap trays in the rinse section of a Hobart C-44 dish machine. An identical bottle filled with city water was placed among the bottles to monitor solution

TABLE I

| | Ingredients (grams/wt-%) | | | | | | | | | | | | | |
|---|---|---|---|---|---|---|---|---|---|---|---|---|---|---|
| Ex. | SK-10 (g/%) | S1-10 (g/%) | P1570S (g/%) | L-1695 (g/%) | S-1170 (g/%) | F-90 (g/%) | 1-M (g/%) | 1-L (g/%) | 3-1-S (g/%) | TSPP (g/%) | NaCl (g/%) | sucrose (g/%) | glycine (g/%) | Other (g/%) |
| 1 | 30/10 | | 165/55 | 30/10 | | | 30/10 | | | 30/10 | 15/5 | | | |
| 2 | 30/10 | | 150/50 | 21/07 | | | | 21/07 | | 30/10 | 48/16 | | | |
| 3 | 135/10 | | 675/50 | 94/07 | | | | 108/08 | | 135/10 | 202/15 | | | |
| 4 | 225/12 | | 900/50 | | 225/12 | | | | | | 180/10 | 180/10 | | 90/05 (poly-glycol) |
| 5 | 12/25 | | 12/25 | | 05/10 | | | | 05/10 | | | | 05/10 | 10/20 ($Na_2SO_4$) |
| 6 | 05/10 | | 20/40 | | 05/10 | | | | 05/10 | | | | 05/10 | 10/20 ($Na_2SO_4$) |
| 7 | 20/40 | | | | 07/15 | 02/05 | | | 05/10 | | | | 05/10 | 10/20 ($Na_2SO_4$) |
| 8 | 15/30 | | 05/10 | | 10/20 | | | | 05/10 | | | | 05/10 | 10/20 ($Na_2SO_4$) |
| 9 | 12/25 | | 10/20 | | 07/15 | | | | 05/10 | | | | 05/10 | 10/20 ($Na_2SO_4$) |
| 10 | 30/10 | | 120/40 | | 30/10 | | | | 30/10 | | | | 30/10 | 60/20 ($Na_2SO_4$) |
| 11 | 31/12 | | 125/50 | | 31/12 | | | | | | 25/10 | 25/10 | | 12/5 ($C_3$ glycol) |
| 12 | 06/12 | | 25/50 | | 7/15 | | | | | | 7/15 | | | 03/07 ($C_3$ glycol) |
| 13 | 05/10 | | 20/40 | | 6/13 | | | | | | 7/15 | | | 08/17 (1-S) 02/05 ($C_3$ glycol) |
| 14 | 18/36 | 07/14 | | | | | | | | | | | 07/15 | 02/05 (P-1670) 12/25 ($Na_2SO_4$) 02/05 ($H_2O$) |

Nomenclature for Table I

SK-10 TM A sorbitan monocaprylate available from the Nikko Chemicals Company, Limited of Tokyo, Japan.

SL-10 TM A sorbitan monolaurate available from the Nikko Chemicals Company, Limited of Tokyo, Japan.

P1570S TM A sucrose palmitate containing about 70 wt-% sucrose monopalmitate available from the Mitsubishi Chemical Industries, Ltd. through the distributor Mitsubishi-Kasei Food Corporation under the group mark Ryoto Sugar Ester.

L-1695 TM A sucrose laurate containing about 80 wt % sucrose monolaurate available from Mitsubishi Chemical Industries, Ltd. through the distributor Mitsubishi-Kasei Food Corporation under the group mark Ryoto Sugar Ester.

S-1170 TM A sucrose stearate containing about 55 wt % sucrose monostearate available from Mitsubishi Chemical Industries, Ltd. through the distributor Mitsubishi-Kasei Food Corporation under the group mark Ryoto Sugar Ester.

F-90 TM A powdered sucrose fatty acid ester available from Dai-ichi Kogyo Seiyaku Company of Tokyo, Japan.

1-M TM A decaglyceryl monomyristate available from Nikko Chemicals Company, Limited of Tokyo, Japan under the group mark Decaglyn TM.

1-L TM A decaglyceryl monomyristate available from Nikko Chemicals Company, Limited of Tokyo, Japan under the group mark Decaglyn TM.

3-1-S TM A triglycerol monostearate available from the Durkee Industrial Foods Corp. of Cleveland, Ohio under the group mark Santon TM.

TSPP tetrasodium pyrophosphate.

NaCl sodium chloride.

C3 glycol propylene glycol

1-S TM A decaglyceryl monostearate available from Nikko Chemicals Company, Limited of Tokyo, Japan under the group mark Decaglyn TM.

Figure 5:
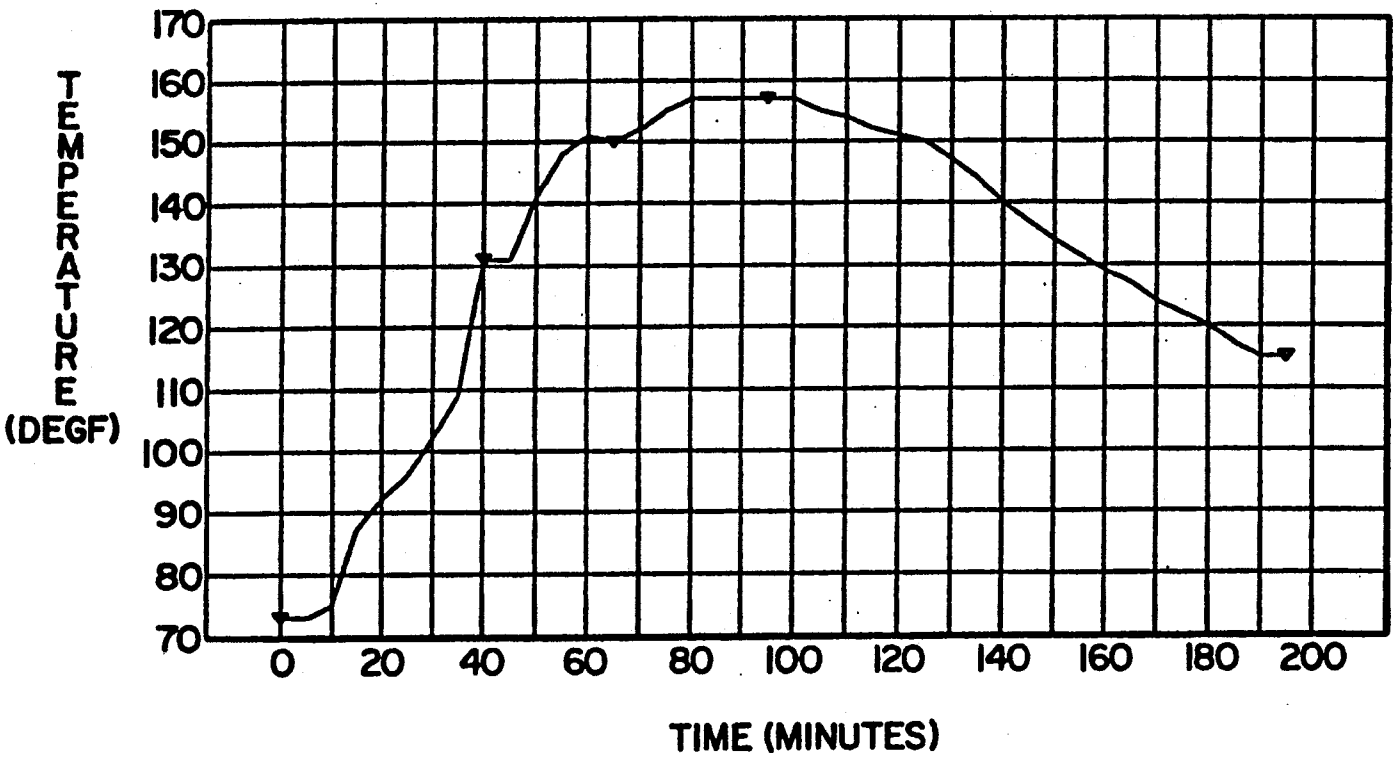
FIG. 5 is a graph of the temperature profile of a dishwashing machine environment during use.

P-1670 TM A sucrose palmitate containing about 80 wt % sucrose monopalmitate available from Mitsubishi Chemical Industries, Ltd. through the distributor Mitsubishi-Kasei Food Corporation under the group mark Ryoto Sugar Ester.

temperature during testing. The dish machine was filled and allowed to come up to operating temperature. The pump was turned on and empty dish racks were run through activating the rinse spray. The rinse water which comes from the booster heater was at a temperature of 180° F. and the bottles were exposed to this rinse spray. The temperature profile during this test can be seen in the graph shown in FIG. 5.

The number of racks run through and the temperature of the solutions was monitored with a millivolt strip-chart recorder, with 35 racks run through the machine over approximately a three hour period. Samples were taken from each bottle at various points during the test to check for viable organisms. Samples taken were later plated out, incubated, and surviving colonies were enumerated. The results are summarized in Table III below.

TABLE III

| | T0 | T1 | T2 | T3 | T4 |
|---|---|---|---|---|---|
| Elapsed Time T | T = 0 min. | T = 40 min. | T = 65 min. | T = 95 min. | T = 195 min. |
| Temperature (deg F.) | 73 | 133 | 150 | 157 | 115 |
| Racks: | | | | | |
| Cumulative Total | 0 | 3 | 10 | 26 | 35 |
| During Interval | 0 | 3 | 7 | 16 | 9 |
| | Bacteria Survivors (cfu/ml)* | | | | |
| Food-Grade Solid Rinse Aid Concentration | | | | | |
| 0.5% | 2,000,000 | <10 | <10 | <10 | <10 |
| 1.0% | 2,200,000 | <10 | <10 | <10 | <10 |
| 2.0% | 1,800,000 | <10 | <10 | <10 | <10 |
| | Mold Survivors (cfu/ml)* | | | | |
| Food-Grade Solid Rinse Aid Concentration | | | | | |
| 0.5% | 3100 | <10 | <10 | <10 | <10 |
| 1.0% | 3200 | <10 | <10 | <10 | <10 |
| 2.0% | 3300 | <10 | <10 | <10 | <10 |

*colony-forming units per milliliter

As shown in Table III, there were less than 10 colony-forming units of bacteria and mold in the tubes containing the rinse aid solutions after 40 minutes of exposure in the heated dish machine environment.

Even though numerous characteristics and advantages of the invention have been set forth in the foregoing description, together with details of the structure and function of the invention, the disclosure is illustrative only and changes may be made in detail, especially in matters of shape, size, and arrangement of parts, within the principles of the invention, to the full extent indicated by the broad general meaning of the appended claims.

What is claimed is:

1. A dispensing system for a solid rinse aid, comprising:

(a) a warewash machine having a plurality of walls defining at least one chamber for washing and rinsing soiled wares;

(b) a dispenser positioned outside of said warewash machine, said dispenser comprising a housing for containing a solid block of rinse aid, and a spray means for directing a dissolving spray of an aqueous liquid at an exposed surface of the solid block of rinse aid, wherein a concentrated rinse aid solution at a substantially constant concentration is provided to an outlet in said dispenser; and (c) a tank for the rinse aid solution having a feed line conduit cooperatively attached to the outlet of said dispenser, said tank attached to an inner surface of one wall of said warewash machine;

wherein the rinse aid solution is directed to said tank from said dispenser outlet through said feed line conduit and stored in said tank for a period of time effective to preserve the rinse aid solution from biological contamination, whereby the rinse aid solution is preserved by an elevated temperature present in said warewash machine during operation thereof.

2. The dispensing system of claim 1 further comprising:

(a) a water supply line connecting said spray means with a pressurized source of water; and (b) a spray control means operatively connected to said water supply line for selectively controlling water flow through said supply line; said spray control means being operative in response to receipt of a control signal to open the water supply line to water flow therethrough, causing the spray means to direct a spray of water against substantially an entire exposed surface of the solid block of rinse aid.

3. The dispensing system of claim 2 further comprising a pump operatively connected to said tank for selectively controlling removal of the concentrated rinse aid solution from said tank, said pump being operative in response to receipt of a control signal to pump the concentrated solution onto a utilization point.

4. The dispensing system of claim 1 wherein said dispenser further comprises:

(a) an upper storage portion defining an upper storage cavity sufficient to retain at least one solid block of rinse aid, said upper storage portion having an upwardly disposed access port for allowing access to said upper storage cavity;

(b) a door operatively engaged to said housing and sealingly positioned across said access port, said door being moveable with respect to said access port to open and close access to said upper storage cavity; and (c) a collector portion integral with and extending continuously downward from said upper storage portion, said collector portion terminating at said outlet of said dispenser.

5. The dispensing system of claim 1, further comprising a booster heater for elevating the temperature of water supplied to said warewash machine, said booster heater connected to a water supply line which is in fluid communication with a rinse aid injection line.

6. The dispensing system of claim 5, wherein the water supplied to said warewash machine is maintained at a temperature of between about 120° to 180° F.

7. The dispensing system of claim 1, wherein said tank is made from a heat resistant material.

8. The dispensing system of claim 1, wherein said tank is made from a material selected from the group consisting of polymethylpentene, polypropylene, and stainless steel.

9. The dispensing system of claim 1, wherein said tank is made from a transparent or translucent material.

10. The dispensing system of claim 1, wherein the solid rinse aid is a food grade rinse aid.

11. The dispensing system of claim 10, wherein the solid rinse aid comprises a sorbitan aliphatic ester, a sucrose aliphatic ester, and a polyglycerol fatty acid ester.

* * * * *